US005871332A

United States Patent [19]

Gray et al.

[11] Patent Number: 5,871,332

[45] Date of Patent: Feb. 16, 1999

[54] CENTRIFUGAL PUMP

[75] Inventors: Ian Gray, Northumberland; John Culler, Tyne and Wear; Ronald Palgrave, Newcastle on Tyne, all of United Kingdom

[73] Assignee: Ingersoll-Dresser Pump Company, Liberty Corner, N.J.

[21] Appl. No.: 454,777

[22] Filed: May 31, 1995

[30] Foreign Application Priority Data

May 31, 1994 [GB] United Kingdom ..... 9410848

[51] Int. Cl.[6] ..... F04D 29/08

[52] U.S. Cl. ..... 415/170.1; 415/110

[58] Field of Search ..... 415/170.1, 110, 415/111, 112

[56] References Cited

U.S. PATENT DOCUMENTS

| | | | |
|---|---|---|---|
| 3,850,550 | 11/1974 | Kaessen | 417/372 |
| 4,812,108 | 3/1989 | Kotera | 415/111 |
| 4,979,875 | 12/1990 | Muller et al. | 415/168.1 |
| 4,997,340 | 3/1991 | Zinsmeyer et al. | 415/111 |
| 5,106,262 | 4/1992 | Oklejas et al. | 415/111 |
| 5,131,806 | 7/1992 | Taga | 415/112 |
| 5,171,126 | 12/1992 | Becker et al. | 415/170.1 |
| 5,248,245 | 9/1993 | Behnke et al. | 415/170.1 |
| 5,297,928 | 3/1994 | Imakiire et al. | 415/112 |
| 5,310,265 | 5/1994 | Stangeland et al. | 415/170.1 |

FOREIGN PATENT DOCUMENTS

| | | | |
|---|---|---|---|
| 0484582A1 | 11/1990 | European Pat. Off. . | |
| 983323 | 12/1982 | U.S.S.R. . | |
| 319020 | 2/1930 | United Kingdom | 415/112 |
| WO 88/02821 | 4/1988 | WIPO . | |

*Primary Examiner*—John T. Kwon
*Attorney, Agent, or Firm*—Robert F. Palermo

[57] ABSTRACT

A centrifugal pump has a rotating shaft (1) with a centrifugal impeller (3) mounted on it. The shaft (1) and impeller (3) are mounted within a stationary casing (7) and a mechanical seal (8) is provided where the shaft (1) passes out through the casing (7). In order to cool rubbing, sealing faces (9, 11) of the seal, fluid is caused to flow along a path from a tip (6) of the impeller, through the casing (7), into a seal chamber (14), through a clearance (15) between a hub (2) of the impeller and the casing (7) and returning through a port (16) in the impeller. In order to act as a vent for and to clear debris from the seal chamber (14), the clearance is located radially outwardly of and remote from the shaft (1). Especially those parts which are moving and are subject to wear can be replaceable.

6 Claims, 4 Drawing Sheets

CENTRIFUGAL PUMP

BACKGROUND OF THE INVENTION

This invention relates generally to a centrifugal pump, and more particularly to a centrifugal pump providing cooling of sealing faces, clearance of debris from seal chambers, and replaceable wear parts.

Centrifugal pumps normally have to have some form of rotary seal at the point where the rotating shaft carrying an impeller passes out through a stationary casing.

The rotary seal can be in the form of a device known as a mechanical seal and mechanical seals require a certain environment in order to operate successfully.

For example, it is important to maintain sufficient pressure in the fluid surrounding the mechanical seal in order to avoid local boiling at the faces of the seal, since boiling can damage the seal and reduce life. Also, it is important to avoid suspended solids in the surrounding fluid since such solids can cause accelerated wear of the seal faces. Finally, prior to start-up, any gas needs to be vented from the immediate vicinity of the seal, i.e. in the so-called seal chamber.

Most existing designs of process pumps achieve maintenance of sufficient pressure in the surrounding fluid by provision of back-pressure clearances. Flushing flow of fluid is arranged to pass from a pump discharge of the impeller back to a suction side of the impeller via such a clearance. This creates higher pressure in and around the mechanical seal. The device to cause this to happen is often referred to as a throat bushing, which is fixed, the clearance being between the inner cylindrical face of the throat bushing and the cylindrical face of the rotating shaft.

A negative effect of known throat bushes is that while sufficient pressure is maintained in the surrounding fluid, suspended solids in the surrounding fluid are not removed and a separate vent hole must be provided to vent any gas prior to start-up. However, the cross-sectional area of the vent hole can be significant relative to the throat bush clearance. This reduces the back-pressure and also encourages wasteful extra leakage.

Any solids flowing into the seal chamber from the impeller discharge tend to get centrifuged to the walls. These solids find it difficult to escape through the throat bush clearance since they have to move against the centrifugal force field. Accordingly, there is a tendency for solids to accumulate at the seal chamber walls but whatever solids do escape could damage the shaft in the vicinity of the clearance.

Finally, it is often necessary to dismantle the pump in order to drain the seal chamber fully.

The foregoing illustrates limitations known to exist in present centrifugal pumps. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a centrifugal pump including a stationary pump casing containing a rotatable shaft and an impeller with a hub by which the impeller is drivably mounted on the shaft, the impeller having an internal fluid flow path with a fluid inlet substantially adjacent said shaft, said fluid flow path extending therefrom in an increasingly radial direction to terminate at a fluid pump discharge outlet at the radially outer tip of the impeller a flushing and cooling fluid flow path extending from the region of said pump discharge outlet, through a wall of the pump casing, into a seal chamber containing a seal for said shaft, through a first clearance between a hub of the impeller and said pump casing, and returning through a wall of said impeller to a suction side of said internal fluid flow path, wherein said first clearance is located radially outwardly of and remote from said shaft, thereby to act, in use, as a vent and to clear debris from said seal chamber.

The foregoing and other aspects will become apparent from the following detailed description of the invention when considered in conjunction with the accompanying drawings.

DETAILED DESCRIPTION

Figure 1:
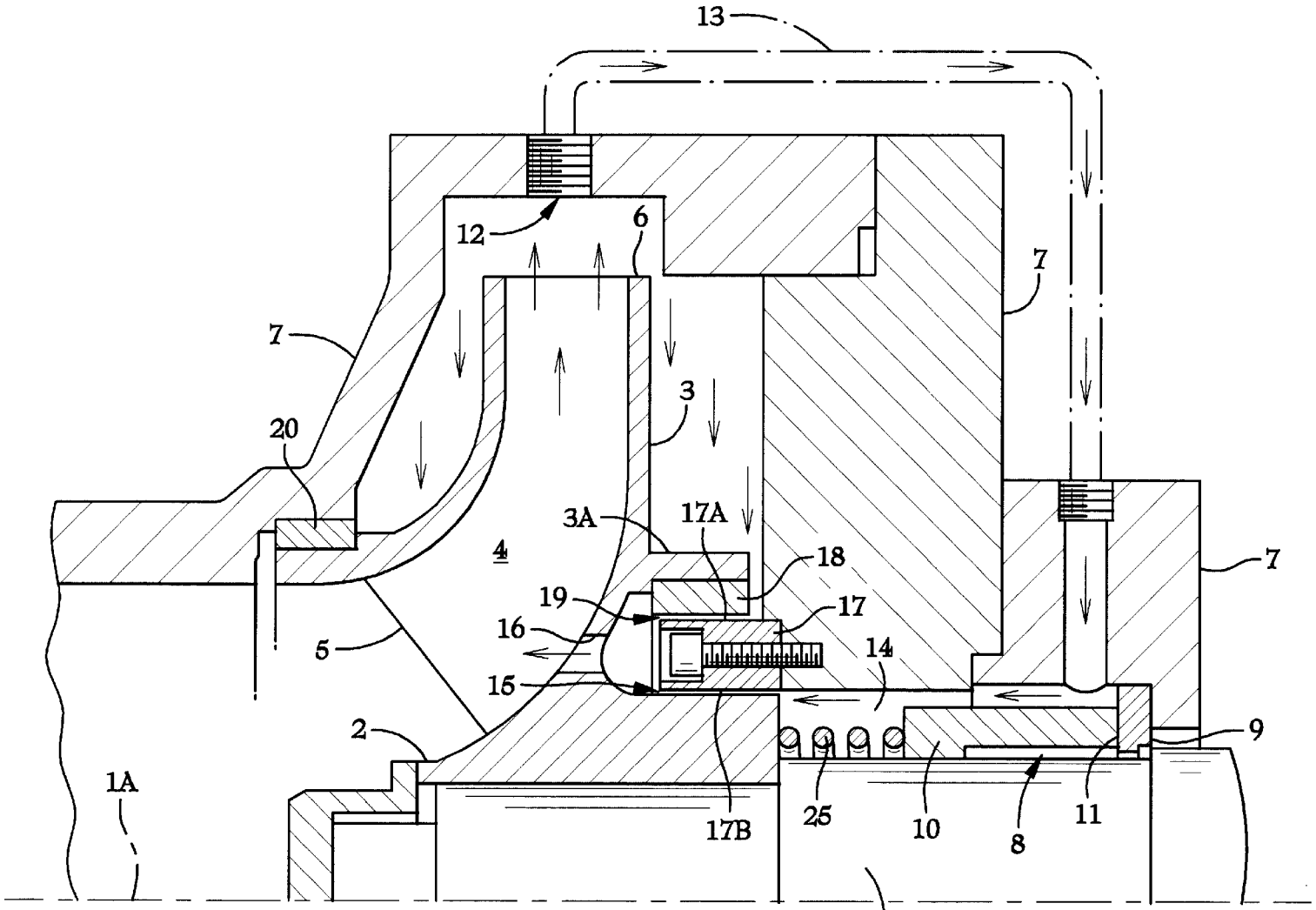
FIG. 1 is a schematic fragmentary cross-sectional view of a pump according to one embodiment of the invention.

Referring to the drawings, FIG. 1 is a diagrammatic sectional view of part of a centrifugal pump with a central axis 1A defined by a rotating shaft 1. A hub 2 of a centrifugal impeller 3 is mounted on the shaft 1, the impeller 3 having an internal fluid flow path 4 which extends in known manner initially in a direction substantially parallel to the shaft 1 at an inlet or suction side 5 and then turns into an increasingly outwardly radial direction to terminate at a fluid pump discharge outlet at the tip 6 of the impeller.

The shaft 1 and impeller 3 are mounted within a stationary casing 7 comprising a plurality of casing parts, and a so-called mechanical seal 8 is provided at the point where the shaft 1 passes out through the casing 7. The seal 8 basically comprises a fixed rubbing face 9 attached to the casing 7 and a rotary member 10 which is fixed on the shaft 1 and which has a rubbing face 11 which is urged by resilient means 25 into sealing contact with the fixed face 9. The two faces 9 and 11 in contact with one another provide the required seal.

In order to cool the rubbing, sealing faces 9 and 11, a fluid flow is arranged in the region of those faces.

As indicated by the flow arrows in FIG. 1, the main fluid flow is caused by centrifugal force to flow from the suction side at the inlet end 5 of the flow path 4, out of the discharge end at the tip 6 of the impeller. The major part of the flow is then caused by the internal profile of the casing 7 to follow an onwards flow path. A port 12 is provided in the wall of the casing 7 opposite, i.e. facing, the discharge end of the flow path 4 and a conduit 13 extends from the port 12 and opens into another part of the casing adjacent the mechanical seal 8.

The mechanical seal 8 is mounted in a seal chamber 14 and the fluid flow path through the conduit 13 flows over the seal 8, through the seal chamber 14 and is then arranged to pass through a first clearance 15 between the case wear ring 17 mounted on the casing 7 and the hub 2 of the impeller 3 and return through a 10 port 16 in the wall of the impeller 3 to the suction side of the impeller. The first clearance 15 provides the required back-pressure to achieve sufficient pressure in the surrounding fluid for the cooling flow path to function.

In the embodiment of FIG. 1, the clearance 15 is constituted by the outer cylindrical face of the hub 2 of the impeller 3 and the inner annular face 17B of an annular case wear ring 17, which protrudes from and is attached to the casing 7 such that the wear ring constitutes a proximal portion of the casing 7.

It will be seen that the clearance 15 is located racially outwardly of and remote from the shaft 1 and is so located that the upstream end of it, i.e. the end leading from the seal chamber 14 is substantially adjacent the inner periphery of the casing 7 which defines the radially outer boundary of the seal chamber 14.

FIG. 1 also shows a renewable wear part 18 which is fixed to a flange 3A on the impeller 3. This wear part 8 surrounds an annular outer face 17A of the case wear ring 17, thereby defining a second clearance 19 between the wear part 18 and the outer annular face 17A. Accordingly, a portion of the fluid flow from the discharge end of the impeller is also caused to flow radially inwardly along the rear face of the impeller 3 and through this second clearance to join the flow through the clearance 15 and thence through the port 16.

With this construction, the seal chamber 14 is able to be self-vented upon start-up, solids can be automatically centrifuged from the chamber because of the radially outward location of the clearance 15 and the seal chamber can also be fully drained.

A further wear part 20 is provided between the wall of the casing 7 and the inlet or suction end 5 of the impeller.

Figure 2:
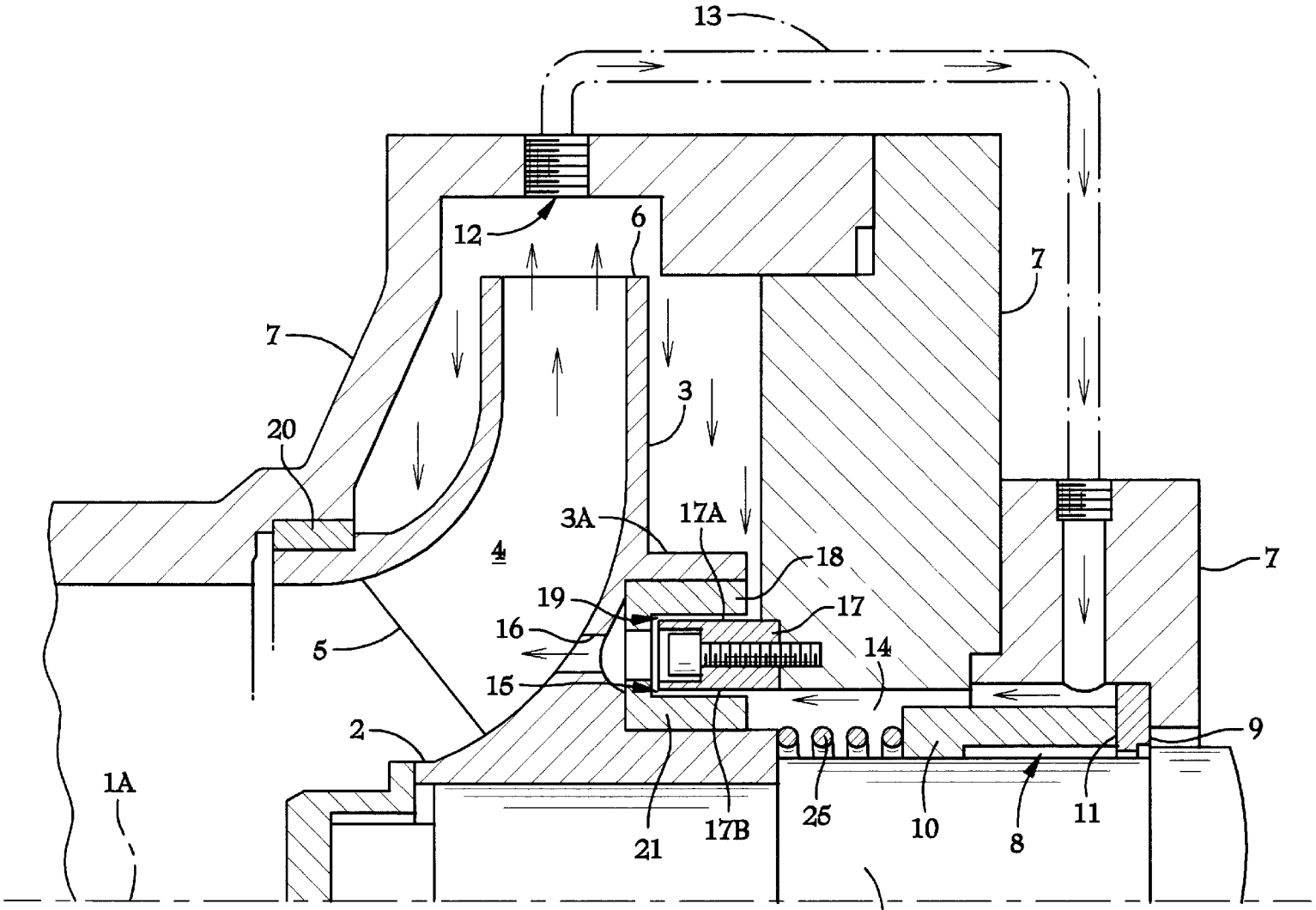
FIG. 2 is a view, as in FIG. 1, of a second embodiment of the pump of the invention.

In the embodiment of FIG. 2, a modification is shown, wherein a further removable wear part 21 is provided on the hub 2 of the impeller, this wear part 21 having an outer annular surface which faces and is surrounded by the inner annular surface 17B of the annular case wear ring 17 so that the first clearance 15 is defined between the renewable wear part 21 and the inner annular surface 17B of the annular case wear ring 17. The second clearance 19, for the radially inflowing fluid behind the back wall of the impeller 3, is provided, in this case also, between the impeller wear part 18 and the outer surface 17A of the case wear ring 17.

Figure 3:
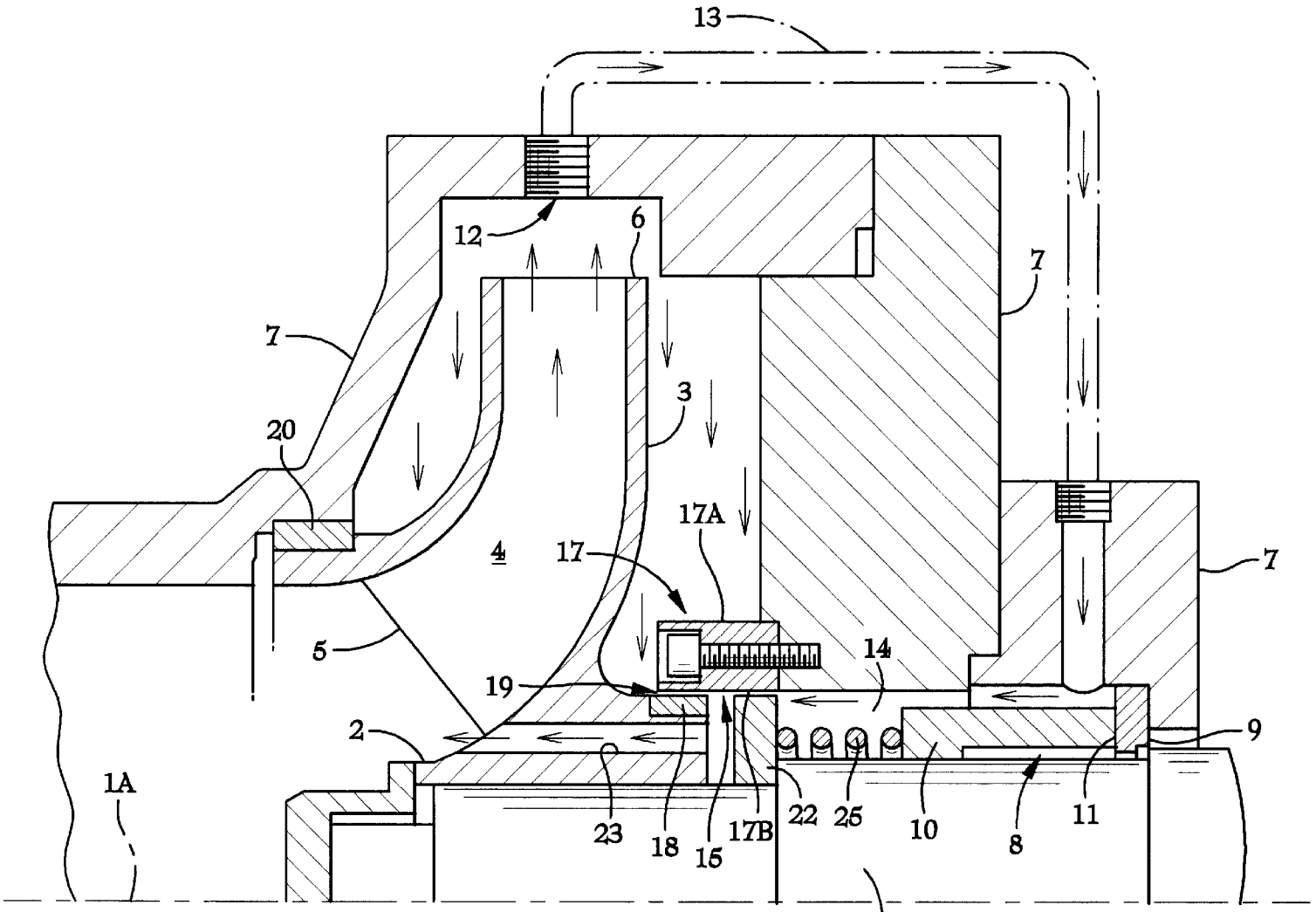
FIG. 3 is a similar view, as in 1 and 2, of a third embodiment of the centrifugal pump of the invention.

In the embodiment shown in FIG. 3, a renewable, annular throat bush 22 is fitted on the shaft 1 to rotate with the shaft and to serve as an extension of the hub 2 of the impeller, an outer cylindrical face of the throat bush 22 defining the first clearance 15 with the inner annular face 17B of the case wear ring 17.

The renewable wear part 18 is relocated in this embodiment so that it also faces the inner annular surface 17B of the annular case wear ring 17 to define the second clearance 19, and it will be seen that the port 23 for returning flushing fluid to the fluid flow path 4 therefore runs as an extended bore 23 through the hub 2 of the impeller 3 parallel to the axis of the shaft 1. The second clearance 19 is thus defined, this time, by the inner surface 17B of the case wear ring 17 and the outer surface of renewable wear part 18.

Figure 4:
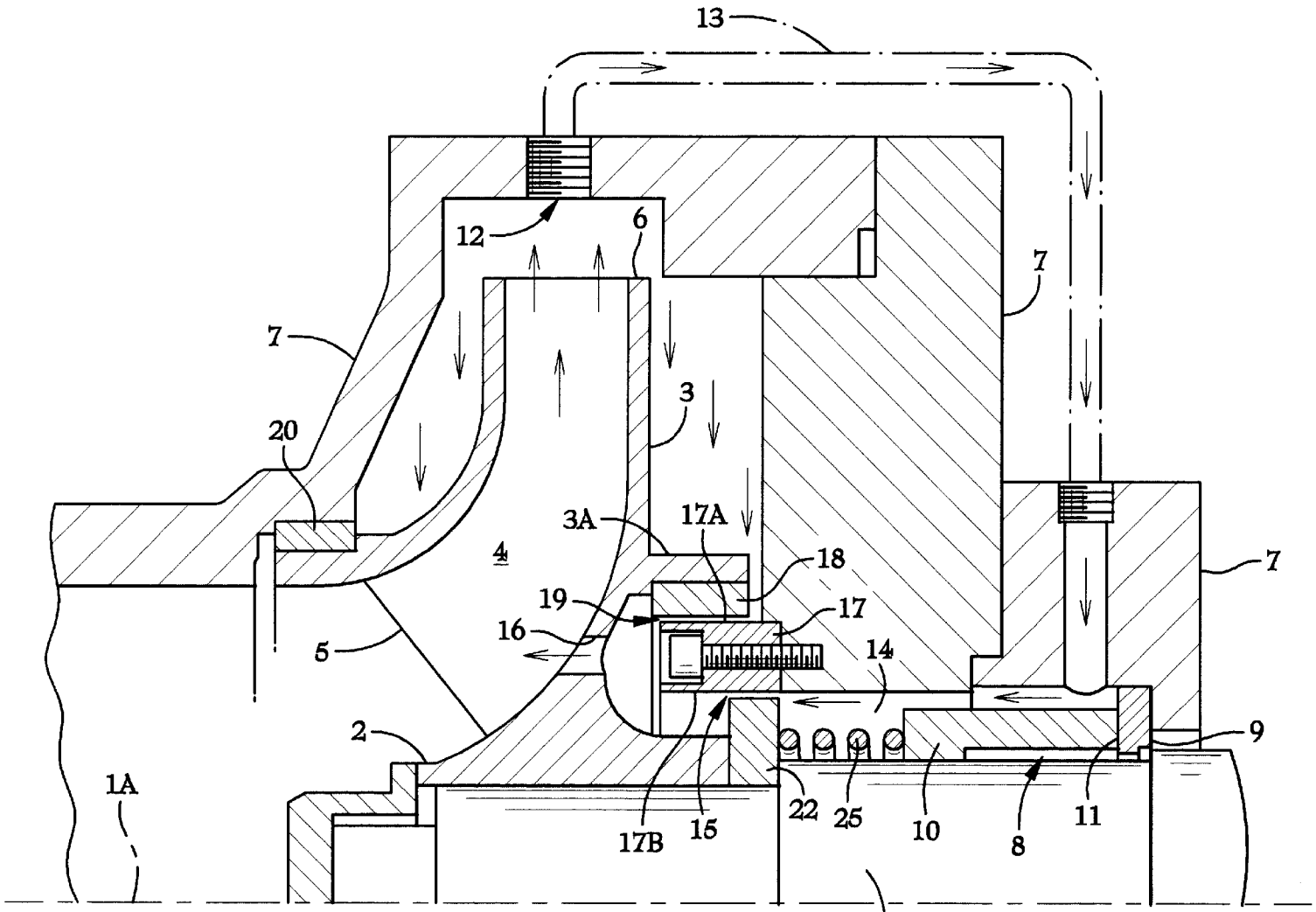
FIG. 4 is again, as in the preceding FIGS., a fourth embodiment of the pump of the invention.

The embodiment shown in FIG. 4 is a combination of the embodiments of FIGS. 1 and 3, wherein the throat bush 22 is again provided as an extension of the hub 2, as it is in FIG. 3, but the renewable wear part 18 is retained on the flange 3A of the impeller, as in FIGS. 1 and 2, to face the outer annular surface 17A of the annular case wear ring 17. In this embodiment, as in that of FIG.3, the first clearance 15 is defined by the outer surface of the throat bush 22 and the inner surface 17B of the case wear ring 17. The second clearance 19, in the embodiment of FIG. 4, is defined by the outer surface 17A of the case wear ring 17 and the inner surface of wear part 18, the same as in FIGS. 1 and 2.

In all cases, the first clearance 15 is arranged aligned with the inner annular profile of the casing 7 where it defines the outer wall of the seal chamber 14 in order to assist in the elimination of debris by centrifugal force from the chamber 14 while obviating the need for a separate vent hole and while enabling the seal 8 to be cooled. There is basically a smooth path between the outer diameter of the seal chamber 14 and the radially outer boundary of the first clearance 15 to facilitate the smooth passage of debris out of the chamber 14, which works as a result of the centrifugal force and the fluid flow. Also, in all cases, the second clearance 19 is arranged, between a wear part 18 on the impeller 3 and a case wear ring 17 to provide pressurized fluid flow radially inwardly along the back wall of the impeller 3 until it meets the flow of fluid from the seal chamber 14 coming through the first clearance 15, and the mixed flows are returned to the suction side of the impeller 3 through port 16, 23.

In the embodiments shown, the pumps have shafts 1 with generally horizontal axes 1A. In these cases, the alignment of the first clearance 15 and uppermost regions of the seal chambers 14 allow natural self-venting. However, the shafts 1 could be in pumps where the shafts are other than horizontal, e.g. vertical, in which case other arrangements may need to be made for venting the seal chamber.

With the present constructions, it should also not be necessary to dismantle the pump to drain the seal chamber since the effect of the centrifugal action on a short "dry" run should be sufficient to clear the seal chamber.

It will be appreciated that with the present constructions, any wear that takes place will occur on renewable surfaces.

What is claimed is:

1. In a centrifugal pump having a stationary pump casing containing a rotating shaft and an impeller on the shaft, the impeller having an internal fluid flow path with a fluid inlet substantially adjacent said shaft, said fluid flow path extending therefrom in an increasingly radial direction to terminate at a fluid pump discharge outlet at the tip of the impeller, the improvement in combination with said centrifugal pump, comprising:

a flushing and cooling fluid flow path extending from the region of said pump discharge outlet, through a wall of the pump casing, into a seal chamber containing a seal for said shaft, through a first clearance between a hub of the impeller and said pump casing, and returning through a wall of said impeller to a suction side of said internal fluid flow path, wherein said first clearance is located radially outwardly of and remote from said shaft, thereby to act, in use, as a vent and to clear debris from said seal chamber.

2. A centrifugal pump according to claim 1, wherein said first clearance is located between an annular case wear ring, which protrudes from and is attached to said pump casing, and the hub of the impeller.

3. A centrifugal pump according to claim 2, wherein the hub of the impeller is provided with a renewable wear part surrounding an outer annular face of the case wear ring, there being a second clearance between the renewable wear part and said outer annular face.

4. A centrifugal pump according to claim 3, wherein the impeller hub is provided with a second renewable wear part surrounded by an inner annular surface of the case wear ring, said second renewable wear part defining with the case wear ring said first clearance.

5. A centrifugal pump according to claim 2, 3 or 4, wherein a throat bush constituting a renewable wear part is mounted on the shaft adjacent the hub of the impeller and extends towards the inner annular face of the case wear ring, the first clearance being defined by a gap between the outer cylindrical face of the throat bush and the inner annular surface of the case wear ring.

6. A centrifugal pump according to claim 1, wherein said seal comprises a fixed rubbing face attached to said pump casing and a rotary member, which is fixed on the shaft and which has a rubbing face which is urged by resilient means into sealing contact with said fixed rubbing face.

* * * * *